United States Patent [19]

McCall

[11] Patent Number: 4,984,440

[45] Date of Patent: Jan. 15, 1991

[54] YARN FINISH APPLICATOR WITH INTERNAL FINISH HEATING CAPABILITY

[75] Inventor: James E. McCall, Signal Mountain, Tenn.

[73] Assignee: E. I. Du Pont de Nemours and Company, Wilmington, Del.

[21] Appl. No.: 445,925

[22] Filed: Dec. 5, 1989

Related U.S. Application Data

[63] Continuation of Ser. No. 201,504, Jun. 2, 1988, abandoned.

[51] Int. Cl.[5] ..... D06B 1/08

[52] U.S. Cl. ..... 68/200; 118/420

[58] Field of Search ..... 8/151.2; 68/200; 118/420

[56] References Cited

U.S. PATENT DOCUMENTS

| | | | |
|---|---|---|---|
| 2,744,563 | 5/1956 | Mennerich | 118/420 X |
| 2,963,739 | 12/1960 | Whitehurst et al. | 118/420 X |
| 2,976,177 | 3/1961 | Warthen | 118/420 X |
| 3,347,208 | 10/1967 | Arridge | 118/420 |
| 3,758,329 | 9/1973 | Garick | 118/420 X |
| 4,109,610 | 8/1978 | Parbhoo et al. | 118/420 X |
| 4,329,750 | 5/1982 | Binnersley | 8/151.2 |
| 4,397,164 | 8/1983 | Binnersley | 68/200 |

*Primary Examiner*—Philip R. Coe

[57] ABSTRACT

A yarn finish applicator includes a body providing a yarn contact surface including a slot with two side walls and a bottom. A passage extends to the slot through the body member so that finish is supplied to the slot by flowing through the passage. Heating capability is provided in the body member for heating the finish as the finish flows to the yarn in the slot.

2 Claims, 2 Drawing Sheets

YARN FINISH APPLICATOR WITH INTERNAL FINISH HEATING CAPABILITY

This application is a continuation of application Ser. No. 201,504, filed June 2, 1988, and now abandoned .

FIELD OF THE INVENTION

This invention relates to an apparatus for applying liquid finish to a moving continuous filament yarn. More particularly, it relates to an improved groove-type finish applicator that provides uniform finish application to a moving continuous filament yarn and includes the internal capability to heat the finish so that it is applied to the yarn at a desired temperature.

BACKGROUND OF THE INVENTION

U.S. Pat. Nos. 4,397,164 and 4,329,750 of common assignee disclose a yarn finish applicator in which finish is metered to a slot running from top to bottom of the applicator. The yarn finish applicator of U.S. Pat. Nos. 4,397,164 and 4,329,750 includes a body member that has top, opposed side, front and back surfaces. A slot with bottom and side walls is formed in the front surface running from top to bottom of the body member. The slot has bottom and side walls with a passage connecting the back surface of the body member through which is metered the desired quantity of liquid finish. The lower portion of the front and back surfaces of the body member are angled downwardly toward each other and in conjunction with the opposed side surfaces which taper downwardly toward each other form an edge at the bottom wall of the slot. Liquid finish is applied to the yarn through a passage in the bottom wall of the slot and the applicator is capable of uniformly applying a finish to the yarn.

Pending application Ser. No. 07/148,584, also of common assignee, discloses a yarn finish applicator having a passage connecting the back surface of the body member to the slot by extending through the bottom wall of the slot and through a portion of each side wall adjacent the bottom wall. This applicator provides enhanced uniformity of finish application when, on occasion, threadline misalignment occurs with respect to the slot in the applicator.

If the above-described finish applicators are to be used for applying a finish which requires heating for application to the yarn, finish is typically supplied to the applicator from a remote reservoir of heated finish. However, for viscous finishes, the uniformity of finish applied is not as high as is desirable due to the inability to accurately control the temperature of and thus the viscosity of the finish being supplied to the yarn in the slot. Moreover, the difficulty increases as the number of finish application positions in a spinning machine increases. Control of finish temperature is particularly a problem during start-up when supply lines are cold and the heated finish is cooled before it reaches the slot. While the finish may be "overheated" at the reservoir so that it reaches the applicator at a desired temperature, this poses the risk that the finish may be degraded.

SUMMARY OF THE INVENTION

In accordance with the present invention, a yarn finish applicator is provided including a body member providing a yarn contact surface including a slot with two side walls and a bottom. A passage extends to the slot through the body member so that finish is supplied to the slot by flowing through the passage. A heating capability is provided in the body member for heating the finish as the finish flows to the yarn in the slot.

In accordance with a preferred form of the present invention, the body member includes a housing member which is connected to and supports a tip member which provides the slot. The passage extends through both the tip member and the housing member. The housing member is thermally conductive and at least one conduit is provided in the housing member for circulating a heated fluid through the conduit so that heat from the circulating fluid is transferred to the housing member to heat the finish.

DETAILED DESCRIPTION OF A PREFERRED EMBODIMENT

Figure 2:
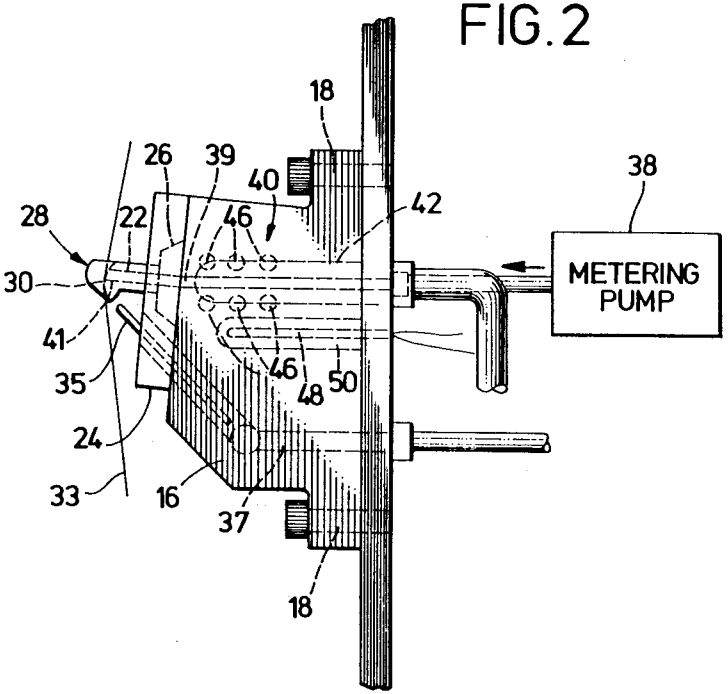
FIG. 2 is a side elevational view of the apparatus of FIG. 1.

Referring now to the drawings in which like reference characters designate like or corresponding parts throughout the several views, a preferred embodiment of the finish applicator 10 in accordance with the invention is illustrated. Applicator 10 includes a body member 12 which is shown attached to an upright support 14. The body member 12 includes a housing 16 which is attached to the upright support 14 by means of bolts 18 which extend through flanged areas 20 at upper and lower areas of the housing. The body member also includes an applicator tip 22 which is secured to the front of the housing 16. As shown in FIG. 2, the tip 22 is secured to the housing by means of retainer 24 which covers an enlarged base 26 of the applicator tip 22. The retainer 24 is secured to the housing by bolts (not shown) or by other such means.

The apparatus 10 illustrated applies finish to yarn in the manner disclosed in U.S. Pat. Nos. 4,397,164 and 4,329,750. U.S. Pat. Nos. 4,397,164 and 4,329,750 are hereby incorporated by reference As shown most clearly in FIGS. 2 and 3, the tip 22 provides a surface including a slot 28 having a bottom 30 and two side walls **32*a* and 32*b*. Yarn 33 is passed through the slot 28 and, as disclosed in U.S. Pat. Nos. 4,397,164 and 4,329,750, the filaments of the yarn 33 are splayed as a single layer and finish is applied to yarn 33 in the slot 28 by means of elongated opening 34 in bottom wall 30**. Yarn as used herein is intended to refer to multifilament continuous yarns or a single-filament threadline.

Referring again to the Figures, finish, preferably heated, is provided to the slot from a supply 36. A housing finish passage 39 extends into and through the housing 16 from the rear to the tip base 26 (FIG. 2). The tip has a tip finish passage 41 which provides fluid communication from the housing passage 39 to the elongated opening 34 at the slot 28. Finish is provided to the housing finish passage 39 by means of metering pump 38 and appropriate lines which supply the proper volume of heated finish during finish application. A blade 35 is provided to catch finish which drips from the slot 28 such as when the yarn is not running in the slot. A return passage 37 is provided through the housing 16 so that finish caught by the blade 35 is returned to the supply 36.

Apparatus 10 includes the internal capability of heating the finish as it is supplied to the slot 28. In the preferred embodiment, this is accomplished by providing a heat exchange system 40 within the housing 16 fabricated of a thermally conductive material such as steel or other metal. Passageways are provided for circulating a heating fluid through the housing 16 to heat the finish as it is supplied to the slot 28.

Figure 3:
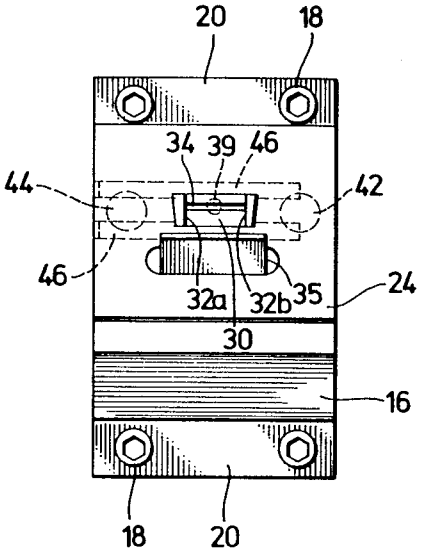
FIG. 3 is a front elevational view of the apparatus of FIG. 1.

The heat exchange system 40 includes an inflow conduit 42 and an outflow conduit 44. As shown in the Figures, the inflow and outflow conduits are provided in the preferred embodiment by boring into the back of the housing on either side of the housing finish passage 39. In the preferred embodiment illustrated, six crossflow conduits 46 are provided within the housing which connect between the inflow conduit 42 and the outflow conduit 44. As illustrated, three of the crossflow conduits 46 are above the passage 39 and three are below. The inflow conduit and the outflow conduit are suitably sized so that the crossflow conduits can be provided above and below the passage 39. As shown in FIG. 3, the crossflow conduits 46 are suitably formed in the housing by boring into the housing from one side so that the resulting bores form the crossflow conduits 46 by intersecting the inflow conduit and the outflow conduit. The bores are then closed at the start of each bore such as by welding.

Figure 1:
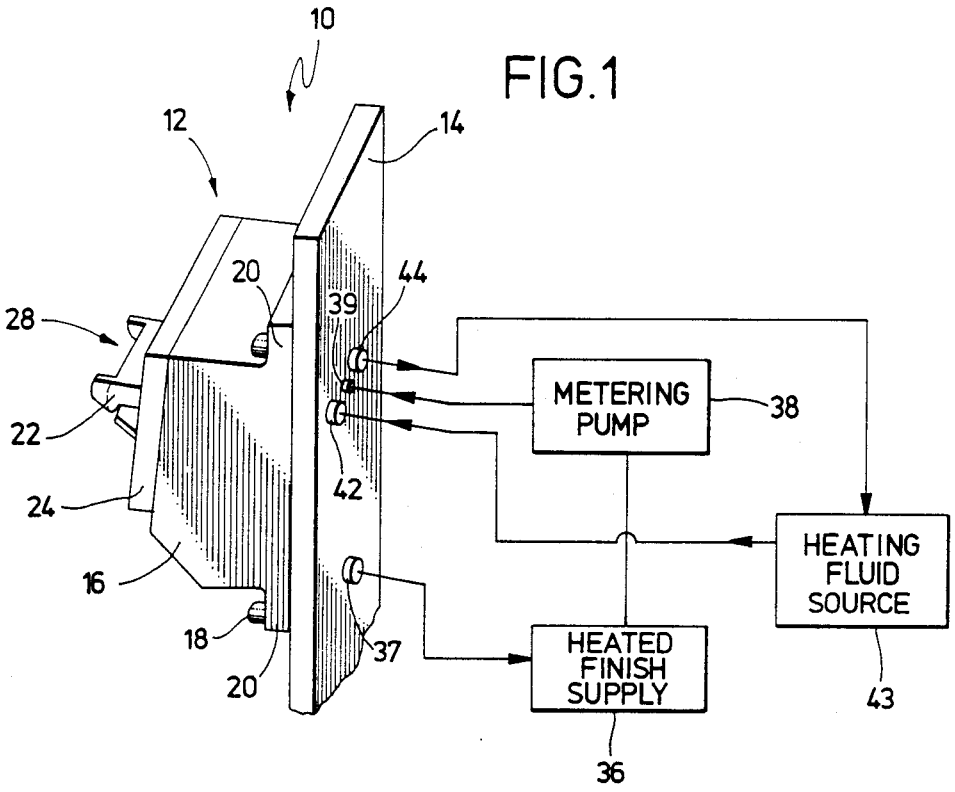
FIG. 1 is a schematic view of a preferred embodiment of a finish applicator in accordance with the invention.

Referring again to FIG. 1, appropriate connections are provided between a heating fluid source 43 so that heating fluid can be circulated into the inflow conduit 42 through the crossflow conduits 46 and out the outflow conduit 44. Heating fluids can be, for example, steam, heated gases, hot water, or synthetic heat transfer fluids such as those sold under trademark DOWTHERM by Dow-Corning. If desired, the heated finish supply 36 can also be the heating fluid source 43 with the finish being used as the heating fluid. As shown in FIG. 2, a thermocouple 48 is provided in a well 50 below the passage 39 and below the crossflow conduits to monitor the internal temperature of the housing 16.

In operation, heating fluid from the source 43 is circulated through the inflow conduit 42 through the crossflow conduits 46 and out the outflow conduit 44 to heat the housing 16. The metering pump 38 meters finish from the supply 36 and supplies it to passage 39 through which the finish flows to the tip passage 41 and in turn to the opening 34 in slot 28. The heat supplied to the housing 16 heats the finish flowing through passage 39 so that the finish is applied to the yarn at the desired temperature. In addition, the housing 16 proximate to the heat exchange system 40 and, at least to limited extent, the applicator tip 22 is heated by the heat supplied by the circulating heating fluid. Thermocouple 48 is used to monitor the internal temperature of the housing 16 so that the heating fluid being circulated can be adjusted to adjust the temperature of the finish.

The yarn finish applicator in accordance with the present invention is ideal for use in applying finishes which must be heated for application to a yarn. As used in this invention, finishes may be any materials needed to facilitate the preparation of the continuous filament yarn or to improve the performance of the yarn in or after fabrication of the end-use article for which the yarn is intended. Typical of the former type of finishes are various combinations of materials such as lubricants, antistats, surfactants, wetting agents, and antioxidants which protect the yarn during its preparation. The latter type of finishes include such materials as softening agents, slickeners, adhesion activators, adhesive agents, antisoilants, etc. Commercial yarns almost always contain a finish of the former type and may also contain one of the latter type. The liquid finish to be applied with the applicator of this invention may be a solution, emulsion or dispersion of the finish material(s) in water or some other appropriate solvent, or it may be a finish material or mixture of the finish materials which is liquid at the application temperature.

The finish may be applied using the apparatus of the invention to continuous filament yarns such as, for example, polyamides, polyaramids, polyolefins, polyesters, polyacrylics, spandex, rayon and cellulose acetate. Through the maintenance of the proper application temperature of the finish, more uniform finish application can be achieved. Moreover, in a machine having a number of different finish application positions, the temperature variability among different positions can be greatly decreased. The temperature of the finish need not be increased above the application temperature and the degradation caused by overheating can be minimized. The benefits are particularly realized at startup since the housing can be preheated to insure that the finish being applied initially is at the proper temperature.

While a preferred embodiment has been shown and described in the foregoing detailed description, it will be understood that the invention is capable of numerous modifications, rearrangements and substitution of parts without departing from the spirit of the invention as set forth in the appended claims.

What is claimed:

1. A yarn finish applicator for multifilament yarn comprising a body member providing a yarn contact surface including a slot with two side walls and a bottom, a metering pump for supplying a metered volume of heated finish from a heated finish supply to said applicator, a passage extending to an opening in said bottom of said slot through said body member so that finish supplied by said metering pump is supplied to said bottom of said slot and onto yarn passing through said slot by flowing through said passage, said bottom of said slot having a width such that the filaments of the yarn are splayed generally as a single layer as the yarn passes through said slot, and heating means in said body member for heating said finish in said passage as said finish flows to the yarn in said slot, said body member comprising a tip member providing said slot and a thermally conductive housing member attached to and supporting said tip member with said passage extending through said tip member and said housing member, said means for heating comprising at least one conduit in said housing and means for circulating a heated fluid through said conduit so that heat from said circulating fluid is transferred to said housing member to heat said finish in said passage, said heated fluid being circulated through said conduit being said heated finish from said heated finish supply.

2. The yarn finish applicator of claim 1 further comprising means for monitoring the internal temperature of the housing.

* * * * *